US005791540A

United States Patent [19]

Sage

[11] Patent Number: 5,791,540

[45] Date of Patent: Aug. 11, 1998

[54] DEVICE FOR REMOVAL OF GUIDE STRIPS FOR COMPUTER PRINTOUT PAPER

[75] Inventor: William L. Sage, Rogers, Ark.

[73] Assignee: Assembled Products Corporation, Rogers, Ark.

[21] Appl. No.: 628,051

[22] Filed: Apr. 8, 1996

[51] Int. Cl.[6] ..... B26F 3/02

[52] U.S. Cl. ..... 225/106; 225/93; 400/621.1

[58] Field of Search ..... 225/1, 101, 106, 225/3, 93, 6; 400/621.1

[56] References Cited

U.S. PATENT DOCUMENTS

| | | | |
|---|---|---|---|
| 2,782,856 | 2/1957 | Staley | 30/363 |
| 4,423,975 | 1/1984 | Krenz | 225/99 X |
| 4,529,113 | 7/1985 | Elliott | 225/106 X |
| 4,657,163 | 4/1987 | Cats | 225/106 |
| 4,782,986 | 11/1988 | Loesche | 225/106 X |
| 4,886,198 | 12/1989 | de Larosiere | 225/106 |
| 4,967,628 | 11/1990 | Judd et al. | 83/455 |
| 4,991,760 | 2/1991 | Coryell | 225/106 |
| 4,993,856 | 2/1991 | Chung | 400/621.1 |
| 5,007,571 | 4/1991 | Nasby et al. | 225/106 |
| 5,072,869 | 12/1991 | Padgetti | 225/106 |
| 5,120,144 | 6/1992 | Lund | 225/100 X |
| 5,259,543 | 11/1993 | Downing | 226/106 X |
| 5,357,832 | 10/1994 | Ferguson | 83/423 |

*Primary Examiner*—Clark F. Dexter
*Attorney, Agent, or Firm*—Boyd D. Cox

[57] ABSTRACT

The guide strip separation device employs a base plate, such that the base plate includes a bottom surface having mounted onto a top surface thereof a row of spaced registration lugs that are received within the apertures of the guide strips to be removed. The registration lugs engage a groove within a cover portion of the device. The cover portion of the device is arranged to engage the guide strip thereby permitting ease of manual grasping of the paper web to effect its separation relative to the associated guide strip thusly clamped by the abutment flange.

10 Claims, 3 Drawing Sheets

DEVICE FOR REMOVAL OF GUIDE STRIPS FOR COMPUTER PRINTOUT PAPER

BACKGROUND OF THE INVENTION

1. Field of the Invention

The advent of computer systems and associated computer printout structure is known in contemporary usage and to this end, printers are accommodated as accessories to such computer systems for projecting paper alphanumeric printouts, typically at a relatively high speed. Such printout is directed onto printout paper which is generally fed from a continuous roll. This printout paper is provided with perforated marginal sides formed by guide strips, with each strip having a row of apertures to direct the paper along a tractor feed device and the like. Such sides are removed subsequently to the printing procedure. Typically, such removal has been effected in a manual manner acquiring undue burden on individuals and wasted labor costs, as well as a non-productive use of time to such manual separation of the marginal sides.

2. Description of the Prior Art

U.S. Pat. No. 2,782,856 to Staley indicates a perforating device, wherein two flaps are hinged at a common end, wherein one of the flaps includes a cutter row and the opposing flap includes a row of apertures to accommodate the cutter row to effect directing of a perforation row onto an associated paper sheet.

The U.S. Pat. No. 4,423,975 issued to Kranz indicates a separation device utilized in combination with an in-line printer of a computer system to separate a margin side of a paper printout, wherein the separation device employs a curvilinear track to direct the margin side in a diverging path relative to the printout sheet.

U.S. Pat. No. 4,529,113 to Elliott sets forth a stripper for removal of margins from a computer paper stack that employs offset ribs to burst the margin strips apart.

U.S. Pat. No. 4,782,986 to Loesche in the removal of margin sheets from perforated flexible sheet materials is directed to removal of the strips by employing opposing jaw portions. Teeth members directed into opposing apertures and a wedge-shaped edge engage a margin portion and separate the same, as the wedge is directed into an opposing groove.

U.S. Pat. No. 4,967,628 to Judd et al. employs a knife edge to effect separation with projecting members arranged to be directed into the perforated apertures to secure the same between opposing jaws.

U.S. Pat. No. 4,991,760 to Coryell sets forth a clamping tool arranged to clamp a margin portion of computer paper and the like to thusly clamp the margin while a user manually grasps the paper web to effect separation of the margin. Further examples of margin removal strips are indicated by the U.S. Pat. Nos. 4,657,163, 5,357,832, 5,346,321, 5,259,543, 5,102,025, 5,120,144, 5,104,022, 5,072,869, and 5,007,571.

The prior art has heretofore failed to provide a device for the removal of guide strips associated with computer printout paper in a convenient manner permitting retrofit relative to existing computer equipment or by individual use in a manner as set forth by the instant invention and to this end, the instant invention sets forth an improvement not heretofore available in the prior art.

SUMMARY OF THE INVENTION

The guide strip separation device employs a base plate, such that the base plate includes a bottom wall having mounted onto a top portion thereof a row of spaced registration lugs that are received within the apertures of the guide strips to be removed. The registration lugs engage a groove within a cover portion of the device. The cover portion of the device is arranged to engage the guide strip thereby permitting ease of manual grasping of the paper web to effect its separation relative to the associated margin strip thusly clamped by the abutment flange.

These and various other advantages and features of novelty which characterize the invention are pointed out with particularity in the claims annexed hereto and forming a part hereof. However, for better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENT(S)

Figure 1:
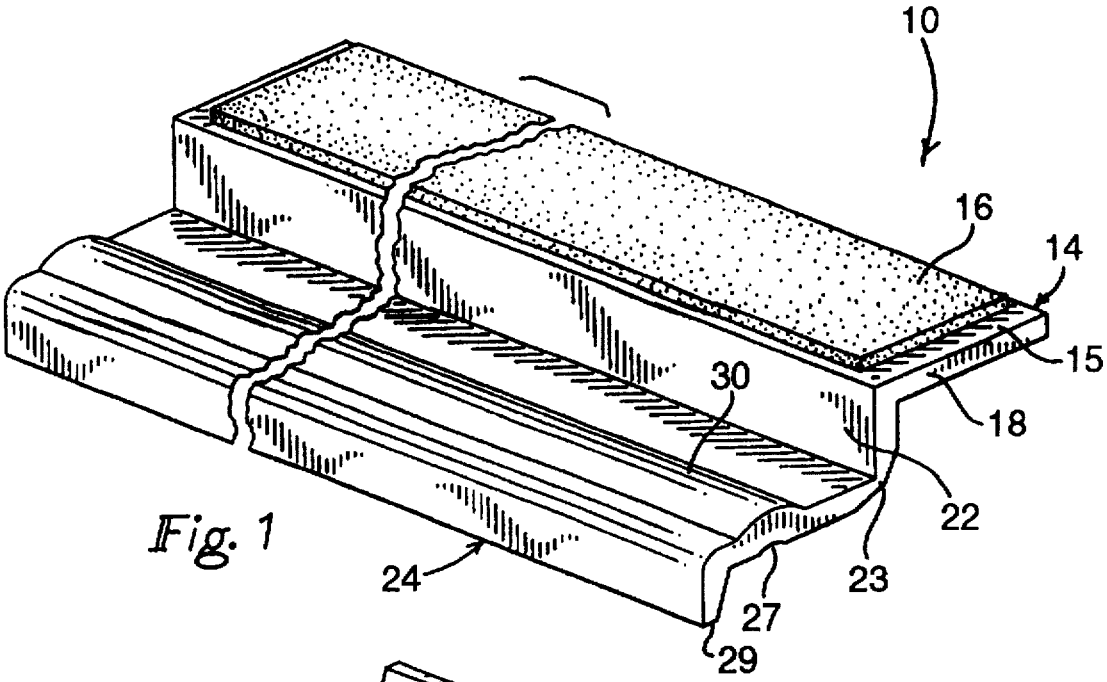
FIG. 1 is a perspective illustration of the invention indicating the exterior surface of the device.
Figure 2:
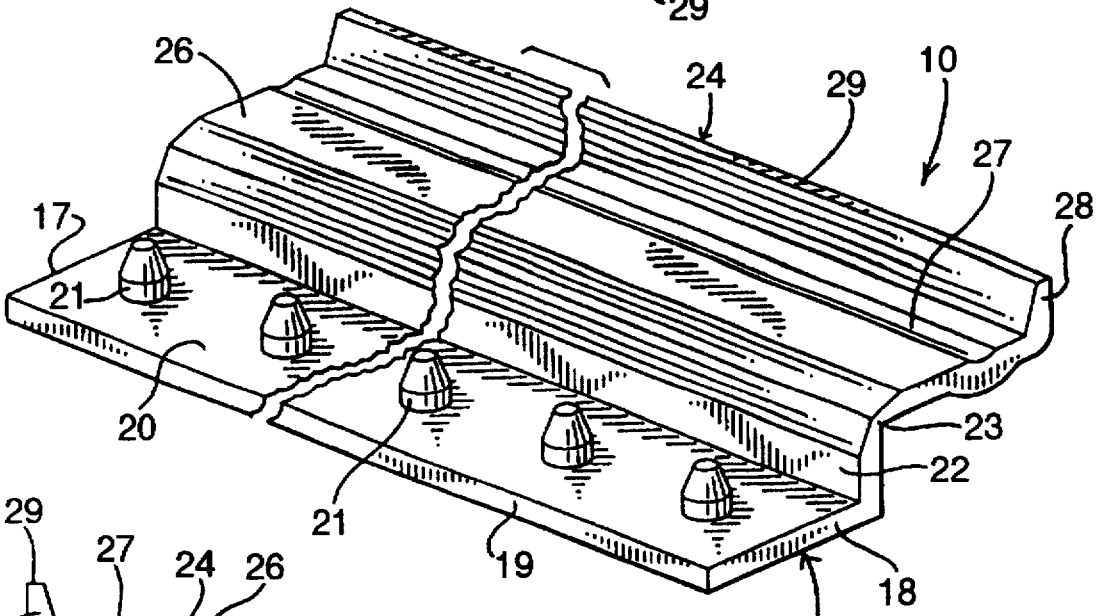
FIG. 2 is a perspective illustration indicating the interior surface of the device.

Referring now to the drawings, wherein like reference numerals designate corresponding structure through the views, and referring in particular to FIGS. 1–10, a device for removal of guide strips for computer printout paper 10 according to the preferred embodiment will now be described.

Figure 4:
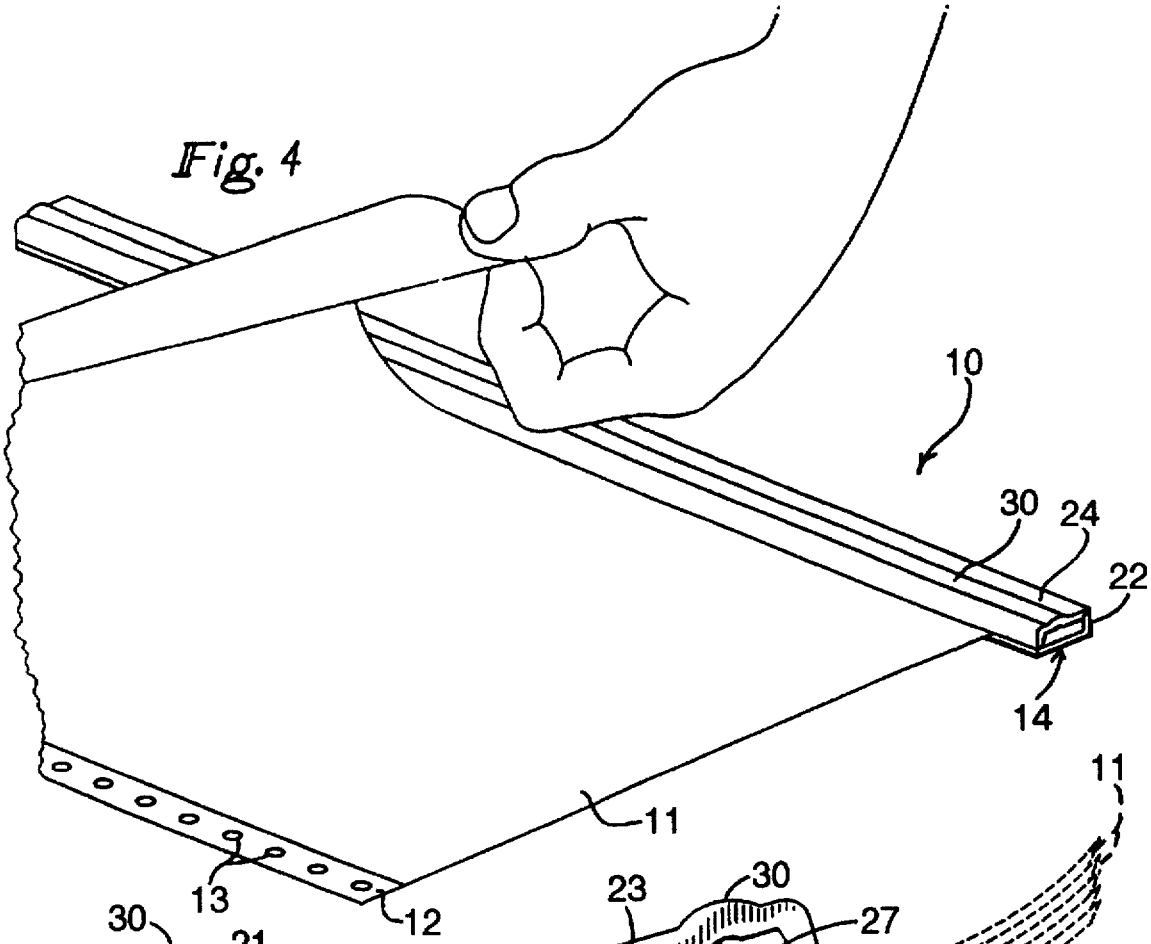
FIG. 4 is a perspective illustration of the invention in use.

A device for removal of guide strips for computer printout paper 10, comprises the use of computer paper 11, such as illustrated in FIG. 4, with such computer paper 11 having separable guide strips 12 to either side of the main web of the computer paper, with each of the guide strips including a row of apertures 13. Each of the apertures are spaced apart a predetermined spacing. The device itself includes a base plate 14 that in turn includes a base plate bottom surface 15 spaced from a base plate top surface 20. An adhesive portion 16 is optionally secured to the base plate bottom surface 15 to accommodate permanent adherence to an underlying support surface (not shown). In this manner, the device 10 as indicated may be used in a fixed site configuration relative to an integral part of a printer. The device 10 may in turn be used remotely from a printer, wherein paper is removed from a printer, transported to the device 10 for subsequent separation of the guide strips 12. The device may be utilized in a portable manner manually grasped in accommodating the separation of guide strips, in a manner such as indicated in the FIGS. 4 and 6 for example.

The base plate 14 is defined by a base plate first end 17 spaced from a base plate second end 18, with a base plate free first side 19 spaced from an opposed coextensive second side 33.

The opposed second side has fixedly secured thereto a side wall 22 mounted to the second side and extending beyond the base plate top surface 20, typically in an angular relationship or as illustrated in an orthogonal relationship. The side wall 22 may extend coextensively with the base plate 14 or may alternatively be directed along a portion of the base plate 14, or the side wall 22 may be formed as a series of side wall portions, inasmuch as the side wall provides for an abutment for the computer paper 11, as well as providing for hinge support of a severing cover 24, to be described in more detail.

Figure 3:
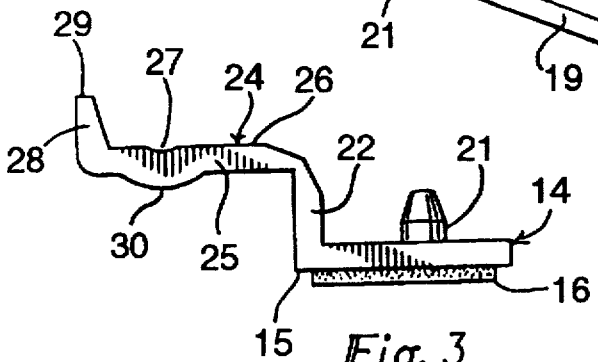
FIG. 3 is an end view, taken in elevation, of the invention.
Figure 5:
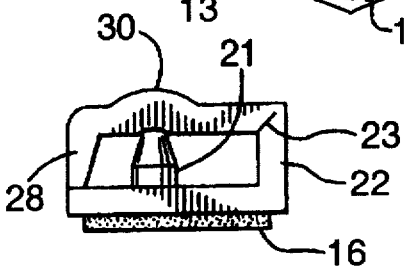
FIG. 5 is an end view, taken in elevation, of the invention in a closed configuration.

A row of registration lugs 21 are fixedly mounted on to the base plate top surface 20, with each of the registration lugs arranged for reception within a respective one of the apertures 13 and thereby the registration lugs 21 are spaced apart said predetermined spacing. Registration lugs 21 are typically formed with a cylindrical base portion 31 extending to a frustroconical construction, and the frustroconical top portions 32 may in fact be of resilient construction as they are arranged to engage the interior surface 26 of the severing cover 24, and more specifically of the first wall 25 of the severing cover 24. The severing cover 24 is formed with the aforenoted first wall 25 extending to an abutment flange 28. The abutment flange has a cross section that is tapered as shown in FIG. 3. Furthermore, the abutment flange is spaced from the hinge portion by a distance that is at least equal to the distance between the base plate free first side and the side wall. The first wall 25 has a registration groove 27 directed along the interior surface 26, with the registration groove 27 arranged to receive the frustroconical portions of the registration lugs 21. In this manner, the registration lugs 21 are secured relative to the severing cover 24 and the severing cover is pivoted about its hinge portion 23 to extend and engage the registration lugs 21 within the registration groove 27. This defines a closed configuration of the device which is illustrated in FIG. 5.

The device 10 is arranged with the abutment flange 28 having a free end wall surface 29, indicated as a free end wall surface, such that the free end wall surface 29 is arranged to engage the guide strip 12 thereby clamping the guide strip and permitting manual separation of the computer paper 11 relative to the guide strip, in a manner as indicated in FIG. 4. To assist in the clamping of the abutment flange 28, a rib 30 projects from an exterior surface 34 of the first wall 25 to provide for reinforcement, as well as orientation of the registration groove 27 by an individual in use. The rib 30 extends over the registration groove 27 in an aligned relationship and has a centerline of the rib 30 spaced from the hinge portion 23 approximately the same distance as a centerline of the groove 27 and the registration lugs 21 are spaced from the hinge portion 23. The rib 30 imparts rigidity to the cover 24 and permits application of manual pressure directly over the registration groove 27.

Figure 6:
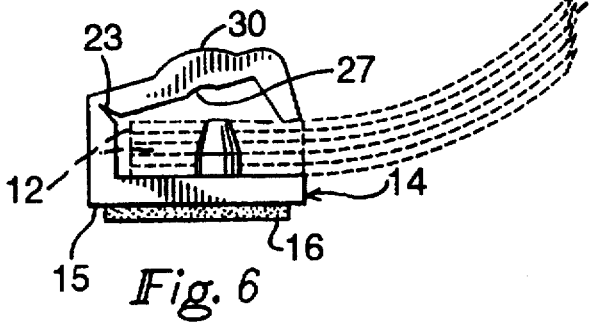
FIG. 6 is an end view, taken in elevation, of the invention arranged for grasping a stack of perforated computer webs.
Figure 7:
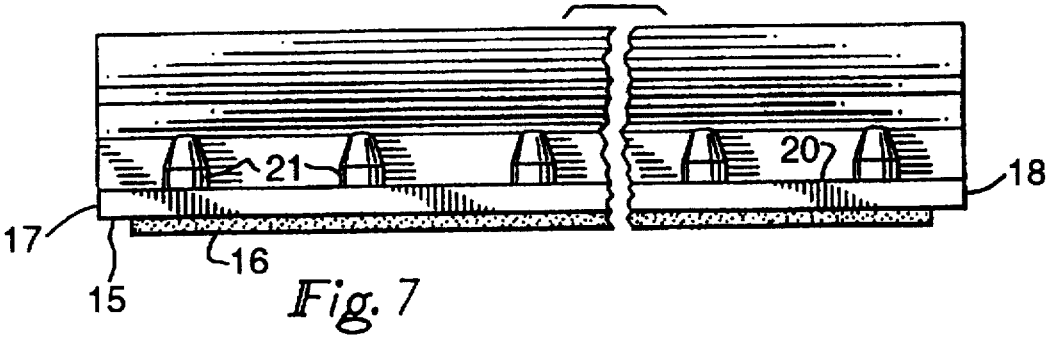
FIG. 7 is a side view, taken in elevation, of the invention.
Figure 8:
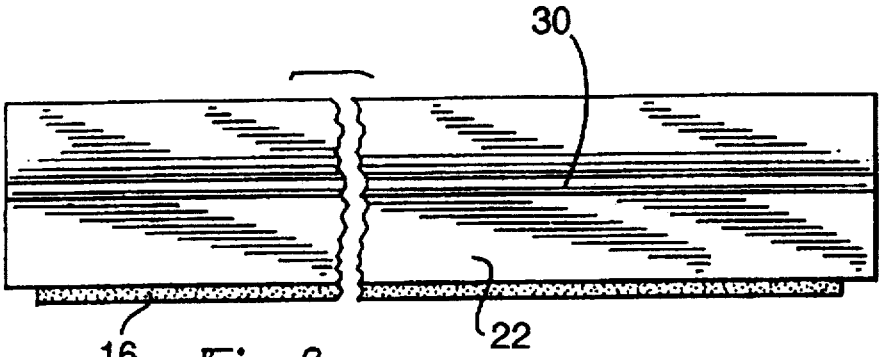
FIG. 8 is an exterior side view of the invention, taken in elevation.
Figure 9:
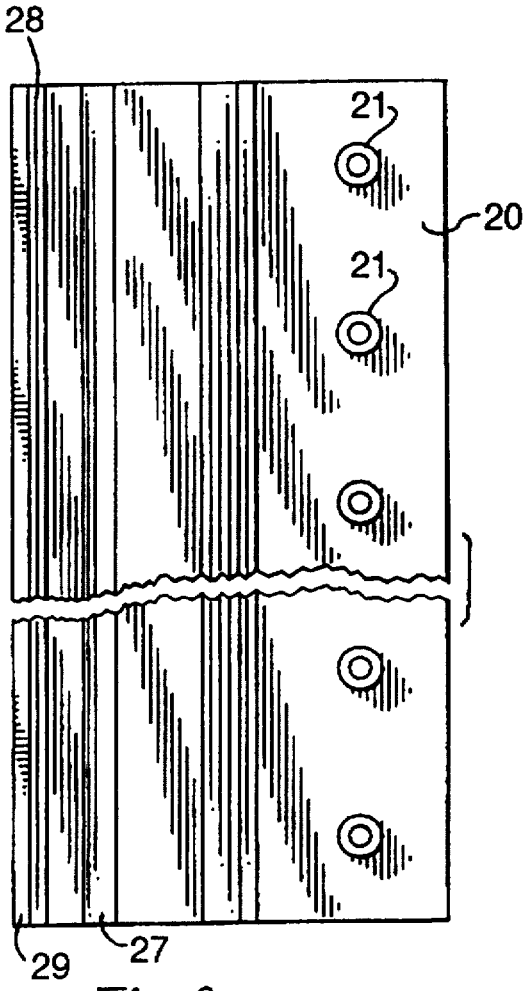
FIG. 9 is a top plan view of the invention in an opened configuration.
Figure 10:
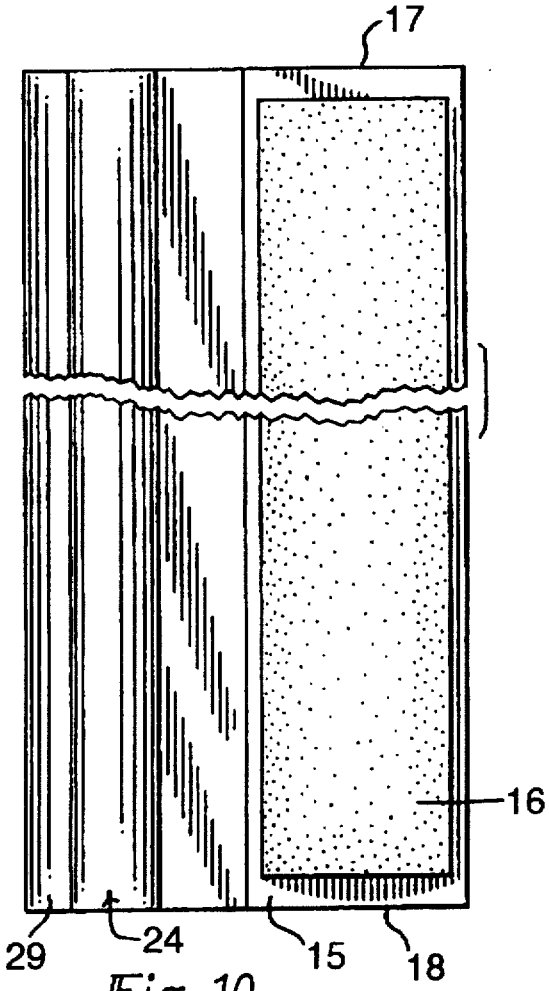
FIG. 10 is a bottom plan view of the invention in a closed configuration.

A stack of the computer paper 11 may be utilized in addition to the utilization of a single computer sheet 11, in a manner as exemplified in FIG. 6, wherein such a stack is clamped in a like manner by the free end wall surface 29 of the abutment flange 28 permitting separation of a stack of guide strips 12 relative to the main web of the computer paper.

The device 10 may be formed of any appropriate material to include polymerics, metal, and the like to provide sufficient rigidity to the structure to permit the clamping of the computer paper, in a manner as indicated in the FIGS. 4 and 6. The registration lugs 21, as noted, may include the construction of the top portion of resilient material but in fact, the cylindrical base portion as well as the frustroconical top portion may all be formed of a rigid material suitable for the purposes intended. The registration lugs 21 indicated with a frustroconical top portion are provided for ease of registration and positioning of the registration lugs within the apertures 13 of the guide strip 12, but it is understood that for purposes of economy of construction and the like, the registration lugs 21 may be formed completely of a cylindrical construction, with the preferred embodiment configuration indicated in the FIG. 2 for example.

It is to be understood, however, that numerous characteristics and advantages of the present invention have been set forth in the foregoing description, together with details of the structure and function of the invention, the disclosure is illustrative only, and changes may be made in detail, especially in matters of shape, size, arrangement of parts within the principles of the invention to the full extent indicated by the broad general meaning of the terms in which the appended claims are expressed.

What is claimed is:

1. A device for removal of guide strips for computer printout paper, comprising:

a base plate means for accommodating at least one sheet of computer paper and having a top surface, side wall means secured to the base plate means and extending above said top surface of the base plate means, a cover means for clamping said computer paper to the top surface, and a hinge portion hingedly mounting the side wall means to said cover means, wherein said top surface includes a plurality of registration lugs fixedly secured thereto projecting above the top surface, said cover means includes a first wall attached at one side to the hinge portion, and an abutment flange attached to another side of said first wall opposite the hinge portion, said first wall comprises an exterior surface and an interior surface, and said interior surface includes a registration groove having a centerline which is spaced from the hinge portion a predetermined spacing, and the exterior surface includes a rib projecting therefrom, wherein the rib has a centerline which is spaced from the hinge portion said predetermined spacing.

2. A device as set forth in claim 1 wherein the base plate means comprises a base plate having a bottom surface spaced from said top surface, the base plate having a free first side spaced from a second side, with said side wall means secured to said second side.

3. A device as set forth in claim 2 wherein each of said registration lugs includes a cylindrical base portion disposed adjacent to said top surface.

4. A device as set forth in claim 3 wherein at least one of said registration lugs includes a frustoconical top portion extending from said cylindrical base portion and projecting therefrom, with said frustoconical portion and said cylindrical base portion coaxially aligned.

5. A device as set forth in claim 4 wherein the frustoconical top portion is made of a resilient material.

6. A device as set forth in claim 2 wherein the abutment flange of said cover means is pivotally aligned with the base plate means.

7. A device as set forth in claim 1 wherein the side wall means is attached to said top surface in an angular relationship.

8. A device as set forth in claim 1 wherein the groove receives each registration lug therein when the cover is in a closed configuration.

9. A device for removal of guide strips for computer printout paper comprising a base plate, the base plate having a top surface spaced from a bottom surface, a free first side spaced from a second side, a plurality of registration lugs integrally secured to the top surface, with the registration lugs including a cylindrical base portion extending to a tapered upper portion, a side wall fixedly secured to the base plate second side and extending therefrom, the side wall disposed at an angular relationship relative to the top surface and terminating in a hinge portion, a cover secured to the hinge portion, the cover extending over the base plate in a substantially coextensive relationship when the device is in a closed configuration, the cover having a first wall extending from the hinge portion, with the first wall extending to an abutment flange, the abutment flange terminating in a free end wall surface disposed in a facing relationship to the top surface when the cover extends over the top surface, and the cover including a registration groove having a centerline disposed parallel to the hinge portion, the first wall having an interior surface and an exterior surface, and the registration groove being formed in the interior surface, and the exterior surface including a rib projecting therefrom, the rib having a centerline spaced from the hinge portion a fixed spacing, and the centerline of the groove spaced from the hinge portion said fixed spacing to provide for manual application and pressure onto the registration groove when the registration groove receives each of the registration lugs.

10. A device for removal of guide strips for computer printout paper, comprising, a base plate means for accommodating at least one sheet of computer paper, side wall means secured to the base plate means and extending above a top surface of the base plate means, a cover means for clamping said computer paper to the top surface, and a hinge portion hingedly mounting the side wall means to said cover means, wherein said top surface includes a plurality of registration lugs fixedly secured thereto projecting above the top surface, said cover means includes a first wall attached at one side to the hinge portion, and includes an abutment flange attached to another side of said first wall opposite the hinge portion, wherein the first wall has an interior surface with a groove therein, the groove having a centerline spaced from the hinge portion a predetermined spacing, and the groove receives said registration lugs therewithin when the cover is in a closed configuration, wherein the first wall further includes an exterior surface spaced from the interior surface, and the exterior surface includes a rib having a centerline and projecting therefrom, wherein the centerline of the rib is spaced from the hinge portion said predetermined spacing and said abutment flange terminates in a free end wall surface extending generally parallel to the first wall, wherein the abutment flange has a cross section which extends across a thickness of the abutment flange in a direction from said abutment flange to said hinge portion, wherein said cross section decreases in width in a direction from the first wall toward the free end wall surface.

* * * * *